US012577739B2

(12) United States Patent
Meier et al.

(10) Patent No.: US 12,577,739 B2
(45) Date of Patent: Mar. 17, 2026

(54) ROLLER TOOL FOR A GROUND PROCESSING ROLLER

(71) Applicant: HAMM AG, Tirschenreuth (DE)

(72) Inventors: Matthias Meier, Tirschenreuth (DE); Günter Rath, Krummennaab (DE); Johannes Malzer, Tirschenreuth (DE); Stefan Bäuml, Tirschenreuth (DE)

(73) Assignee: HAMM AG, Tirschenreuth (DE)

( * ) Notice: Subject to any disclaimer, the term of this patent is extended or adjusted under 35 U.S.C. 154(b) by 758 days.

(21) Appl. No.: 17/969,017

(22) Filed: Oct. 19, 2022

(65) Prior Publication Data

US 2023/0130272 A1 Apr. 27, 2023

(30) Foreign Application Priority Data

Oct. 22, 2021 (DE) ..... 10 2021 127 443.5

(51) Int. Cl.
*E01C 19/23* (2006.01)
*E02D 3/026* (2006.01)

(52) U.S. Cl.
CPC ..... *E01C 19/236* (2013.01); *E02D 3/026* (2013.01)

(58) Field of Classification Search
CPC ..... E01C 19/236; E02D 3/026; E02F 9/28
(Continued)

(56) References Cited

U.S. PATENT DOCUMENTS 3,099,191 A * 7/1963 Thomas ..... E02D 3/026 404/121
3,585,741 A * 6/1971 Heusler ..... E02F 9/2833 299/103
(Continued)

FOREIGN PATENT DOCUMENTS

CN 103867204 A 6/2014
CN 104420413 B 10/2016
(Continued)

OTHER PUBLICATIONS

Chinese Search Report filed in CN202211298089.5 dated Oct. 21, 2022.
(Continued)

*Primary Examiner* — Raymond W Addie
(74) *Attorney, Agent, or Firm* — RANKIN, HILL & CLARK LLP

(57) ABSTRACT

A roller tool for a soil processing roller includes a tool carrier to be fixed to an outer circumferential side of a carrier jacket and has a tethering area for fixedly tethering the tool carrier to an outer circumferential surface of the carrier jacket and an interchangeable holder clamping region, an interchangeable tool having an interchangeable tool shank elongated in the direction of a shank longitudinal axis, an interchangeable holder having an interchangeable holder opening elongated in the direction of an opening longitudinal axis for receiving the interchangeable tool shank of the interchangeable tool to be detachably fixed to the interchangeable holder and with an interchangeable holder counter-clamping region. The interchangeable holder counter-clamping region is brought into clamping interaction with the interchangeable holder clamping region for detachably fixing the interchangeable holder to the tool carrier. A clamping member is supported for generating the clamping interaction with respect to the tool carrier and the interchangeable holder.

20 Claims, 10 Drawing Sheets

Figure 1:
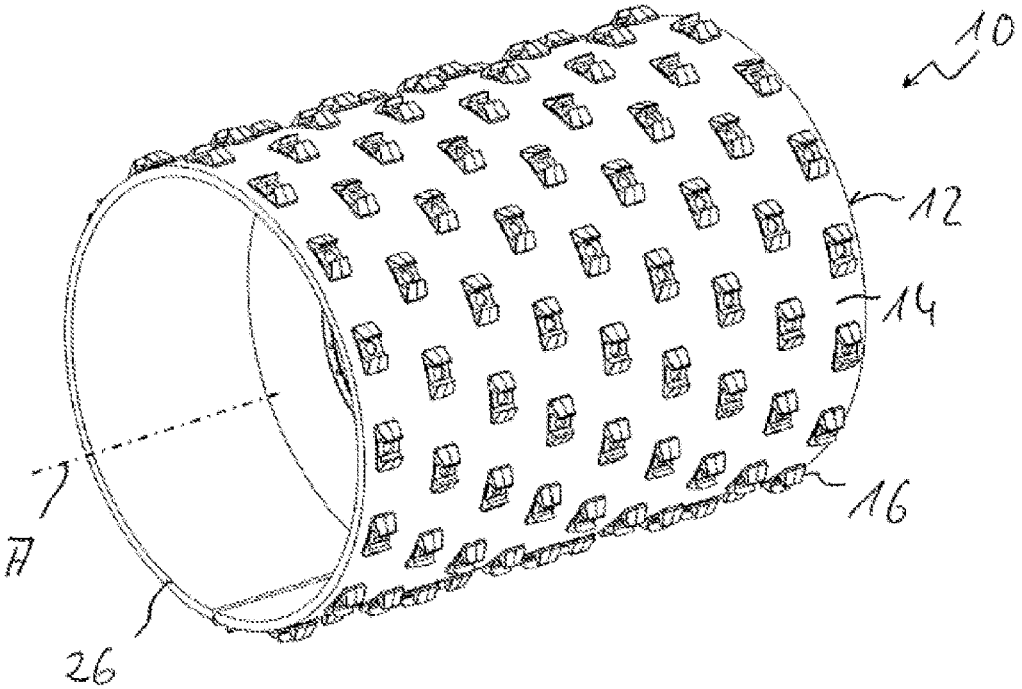

(58) Field of Classification Search
USPC ..... 404/121, 124; 172/122, 540, 554; 299/32, 102, 103
See application file for complete search history.

(56) References Cited

U.S. PATENT DOCUMENTS

| | | | | | |
|---|---|---|---|---|---|
| 4,212,559 | A * | 7/1980 | Persson | B23B 31/113 | 403/379.5 |
| H946 | H | 8/1991 | Lonn | | |
| 5,607,206 | A * | 3/1997 | Siddle | E21C 35/193 | 299/102 |
| 6,682,262 | B2 * | 1/2004 | Caron | E02D 3/026 | 404/124 |
| 9,206,576 | B2 * | 12/2015 | Meier | E02D 3/026 | |
| 9,376,775 | B2 * | 6/2016 | Meier | E01C 19/236 | |
| 9,382,673 | B2 * | 7/2016 | Meier | E02D 3/039 | |
| 2002/0114667 | A1 * | 8/2002 | Kaldenberg | E02D 3/026 | 404/124 |
| 2004/0033107 | A1 * | 2/2004 | Caron | E02D 3/026 | 404/124 |
| 2005/0225162 | A1 * | 10/2005 | Gibbins | E02D 3/026 | 301/43 |

FOREIGN PATENT DOCUMENTS

| | | | | |
|---|---|---|---|---|
| CN | 219080054 | U | 5/2023 | |
| DE | 1297042 | | 6/1969 | |
| DE | 102013217042 | | 8/2013 | |
| DE | 102013217043 | | 8/2013 | |
| EP | 1283924 | | 2/2003 | |
| EP | 3023547 | | 1/2012 | |
| EP | 3093393 | | 1/2012 | |
| EP | 2843135 | | 3/2015 | |
| EP | 3741501 | A1 | 11/2020 | |
| EP | 3951065 | B1 * | 12/2023 | E01C 19/266 |
| GB | 2223045 | A * | 3/1990 | E21C 35/193 |

OTHER PUBLICATIONS

Chinese Office action filed in CN202211298089.5 dated Apr. 25, 2025.

German Patent and Trademark Office Search Report n DE 10 2021 127443.5, issued Aug. 4, 2022, 8 pages.

European Patent Office Search Report EP 22 19 6447, issued Mar. 7, 2023, 10 pages.

* cited by examiner

ROLLER TOOL FOR A GROUND PROCESSING ROLLER

The present invention relates to a roller tool for a soil processing roller of a soil processing machine.

From EP 3 093 393 A1, a roller tool for a soil processing roller is known, which comprises an interchangeable holder fixed with its attachment portion to an outer circumferential surface of a roller jacket of a soil processing roller by welding. An interchangeable holder opening is formed in the one-piece interchangeable holder, into which an interchangeable tool shank of an interchangeable tool designed, for example, as a chisel is inserted by moving in the direction of an opening longitudinal axis of the interchangeable holder opening and is locked therein by latching. The interchangeable tool can be pressed out of the interchangeable holder opening by means of a tool to be inserted through a lateral opening in the interchangeable holder part and positioned to engage behind the interchangeable tool shank.

DE 10 2013 217 042 A1 discloses a roller tool for a soil processing machine, which comprises an interchangeable holder fixed with its attachment portion to an outer circumferential surface of a roller jacket of a soil processing roller by welding. The interchangeable holder has an interchangeable holder opening into which an interchangeable tool shank of an interchangeable tool in the form of a chisel, for example, is inserted by moving it in the direction of a longitudinal axis of the interchangeable holder opening. To lock the interchangeable tool on the interchangeable holder, end elements are inserted from both sides into lateral openings provided on the interchangeable holder, which on the one hand close off the lateral openings provided in the interchangeable holder against the penetration of impurities and on the other hand engage with the interchangeable tool shank and thereby lock the interchangeable tool on the interchangeable holder.

It is the object of the present invention to provide a roller tool for a soil processing roller of a soil processing machine, in which an interchangeable tool can be reliably fixed to an interchangeable holder and can be easily detached from the interchangeable holder even after a long period of operation.

According to the invention, this object is solved by a roller tool for a soil processing roller of a soil processing machine, comprising

- a tool carrier to be fixed to an outer circumferential side of a carrier jacket, having a tethering area for fixedly tethering the tool carrier to an outer circumferential surface of the carrier jacket and an interchangeable holder clamping region,
- an interchangeable tool with an interchangeable tool shank elongated in the direction of a longitudinal shank axis,
- an interchangeable holder with an interchangeable holder opening elongated in the direction of a longitudinal opening axis for receiving the interchangeable tool shank of the interchangeable tool to be detachably fixed to the interchangeable holder and with an interchangeable holder counter-clamping region, wherein the interchangeable holder counter-clamping region is to be brought into clamping interaction with the interchangeable holder clamping region for detachably fixing the interchangeable holder to the tool carrier,
- a clamping member to be supported for generating the clamping interaction with respect to the tool carrier and the interchangeable holder.

By using a clamping member by means of which a respective interchangeable holder can be brought into clamping interaction with a tool carrier fixed to a carrier jacket, both the operation for releasably fixing an interchangeable holder to a tool carrier can be performed in a simple manner, and the operation for removing an interchangeable holder from a tool carrier can be performed by merely positioning the clamping member in a clamping state producing the clamping interaction or removing it from this state.

For generating the clamping interaction, the interchangeable holder clamping region on the tool carrier can comprise a tool carrier clamping recess, wherein the tool carrier clamping recess is bounded by a first clamping surface and a second clamping surface opposite the first clamping surface, and the interchangeable holder counter-clamping region on the interchangeable holder can comprise an interchangeable holder clamping projection to be positioned in an engaging manner in the tool carrier clamping recess, wherein a first counter-clamping surface to be brought into contact with the first clamping surface by means of the clamping member for producing the clamping interaction is provided on the interchangeable holder clamping projection, and wherein a second counter-clamping surface to be brought into contact with the second clamping surface for producing the clamping interaction is provided on the clamping member.

In order to be able to provide a reliable clamping interaction, in particular also in a direction radially outward with respect to a roller rotation axis, it is proposed that the first clamping surface and the second clamping surface are inclined towards each other in a direction away from the tethering area, or/and that the first clamping surface and the second clamping surface are inclined towards each other in a direction orthogonal to the direction away from the tethering area, or/and that the first clamping surface, the second clamping surface, the first counter-clamping surface and the second counter-clamping surface are substantially uncurved.

In a particularly advantageous embodiment, a third clamping surface may be provided on the interchangeable tool shank, and a third counter-clamping surface to be brought into contact with the third clamping surface for producing the clamping interaction may be provided on the clamping member. In this way, the interchangeable tool is also included in the clamping interaction, so that by means of a single clamping member both an interchangeable holder can be releasably fixed to a tool carrier by generating the clamping interaction, and an interchangeable tool involved in this clamping interaction can be releasably fixed to the interchangeable holder and thus also to the tool carrier.

For this purpose, for example, an interchangeable tool clamping recess which is open essentially transversely to the longitudinal axis of the shank and provides the third clamping surface can be provided on the interchangeable tool shank.

For example, the third clamping surface may be concavely curved, and the third counter-clamping surface may have a complementary convex curvature to the third clamping surface.

In order to be able to bring the clamping member into clamping interaction with the various system areas to be clamped on the one hand, and to be able to position it stably on the interchangeable holder on the other hand, it is proposed that the clamping member has a clamping member shank elongated in the direction of a longitudinal axis of the clamping member and, for example, a clamping member head, and that the clamping member shank is designed to taper at least in regions in the direction of the longitudinal axis of the clamping element, for example away from the clamping member head.

In particular, when providing the convexly curved third counter-clamping surface on the clamping member shank, for example, the convexly curved third counter-clamping surface for providing the structure of the clamping member shank tapering in the direction of the shank longitudinal axis may be substantially in the shape of a circumferential portion of a truncated cone.

For attaching and fixing the clamping member to the interchangeable holder, a clamping member through-engagement opening and a fastening member through-engagement opening opposite the clamping member through-engagement opening may be provided in the interchangeable holder, wherein, in order to produce the clamping interaction, the clamping member is to be positioned so as to pass through the clamping member through-engagement opening and a fastening member holding the clamping member in the clamping member through-engagement opening is to be positioned so as to pass through the fastening member through-engagement opening.

In order to be able to provide a stable fastening interaction between the clamping member and the fastening member, it is proposed that a fastening threaded area is provided on the clamping member, and that a counter-fastening threaded area to be threadedly engaged with the fastening threaded area is provided on the fastening member for retaining the clamping member in the clamping member through-engagement opening.

To this end, for example, the fastening threaded area may include an internal thread formed in an opening of the clamping member, and the counter-fastening threaded area may include an external thread formed on a fastening member shank of the fastening member.

In order to protect the tool carrier, which is to be fixed to a carrier jacket, against external effects, it is proposed that the interchangeable holder comprises an interchangeable holder body having a tool carrier receiving recess which receives the tool carrier substantially completely.

In such an embodiment, the interchangeable holder clamping projection may be formed extending from the interchangeable holder body into the tool carrier receiving recess.

The invention further relates to a soil processing roller comprising a plurality of roller tools constructed according to the invention, wherein the tool carriers of the roller tools are firmly attached to a carrier jacket by bolting or welding, preferably in each case a weld seam surrounding the tethering area of a respective tool carrier essentially without interruption.

The carrier jacket can be a roller jacket of the soil processing roller or can be a wrapping jacket to be arranged surrounding the roller jacket of the soil processing roller.

The invention further relates to a soil processing machine comprising at least one soil processing roller constructed according to the invention.

Figure 2:
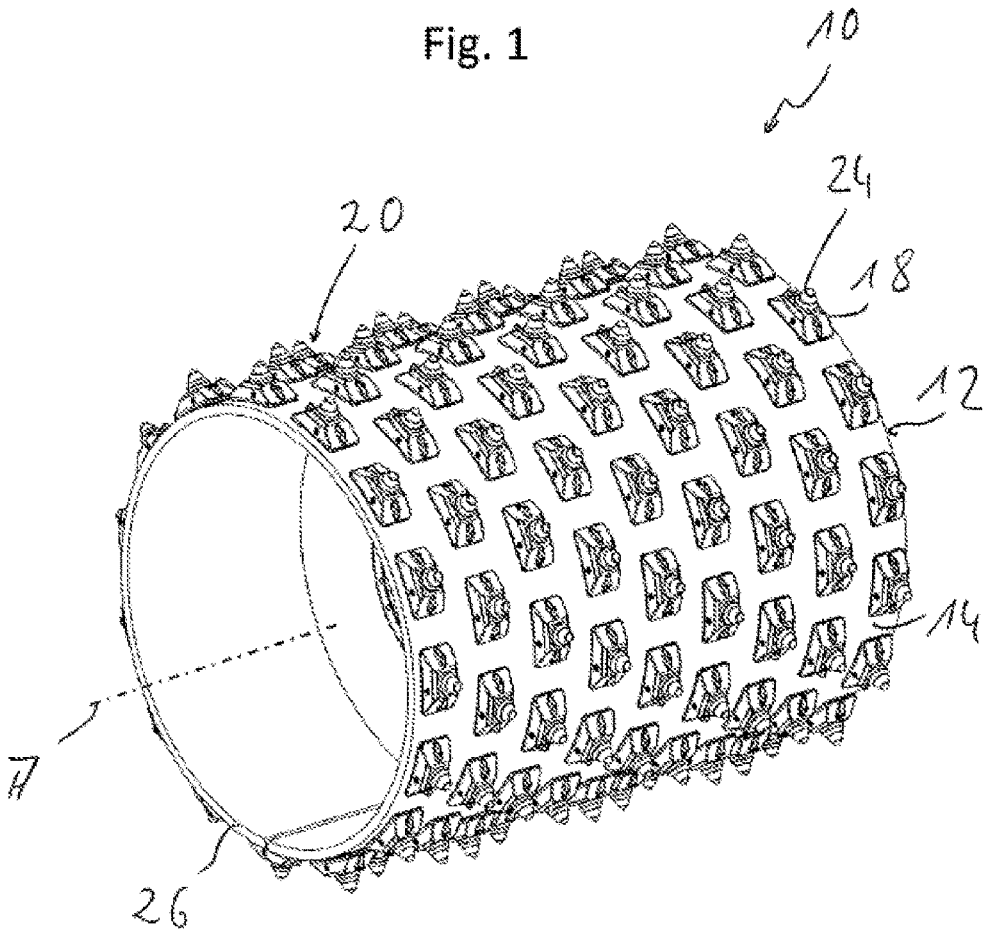
Figure 3:
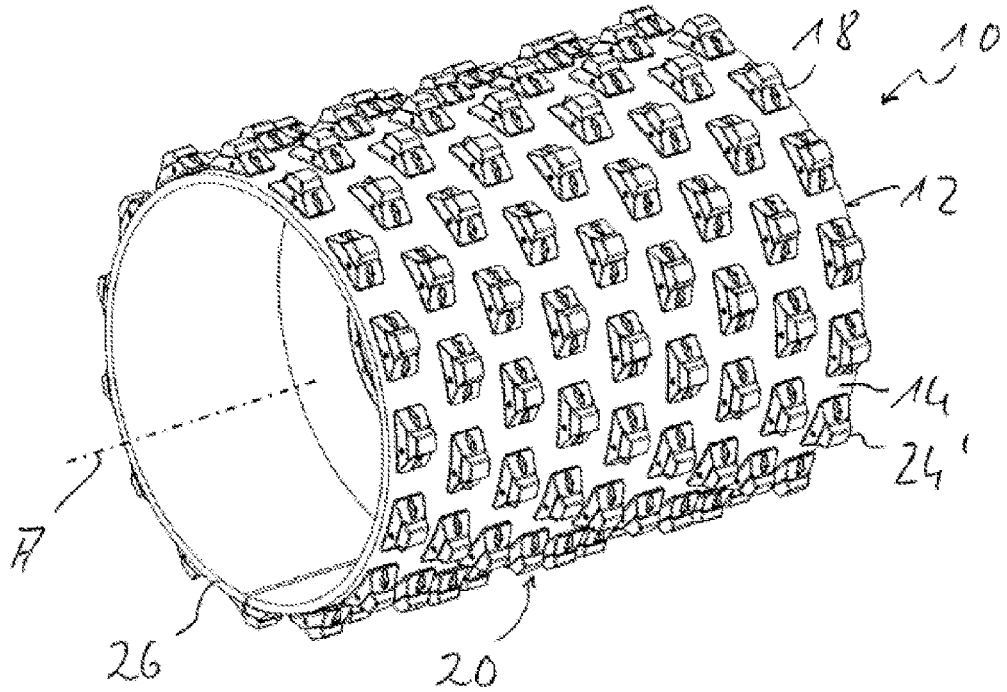
Figure 4:
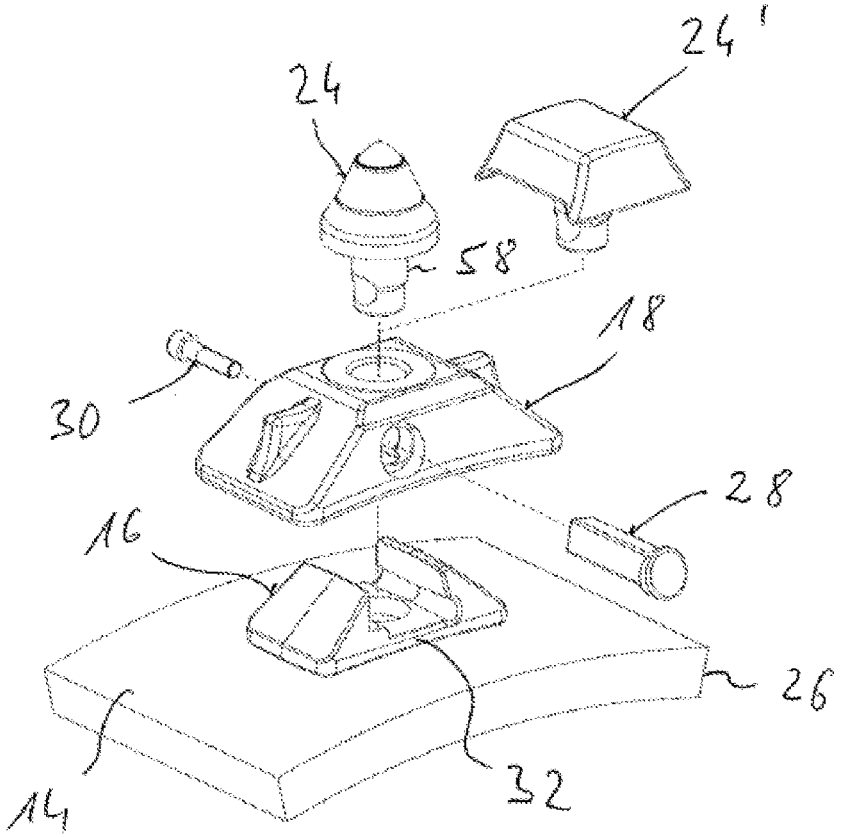
Figure 5:
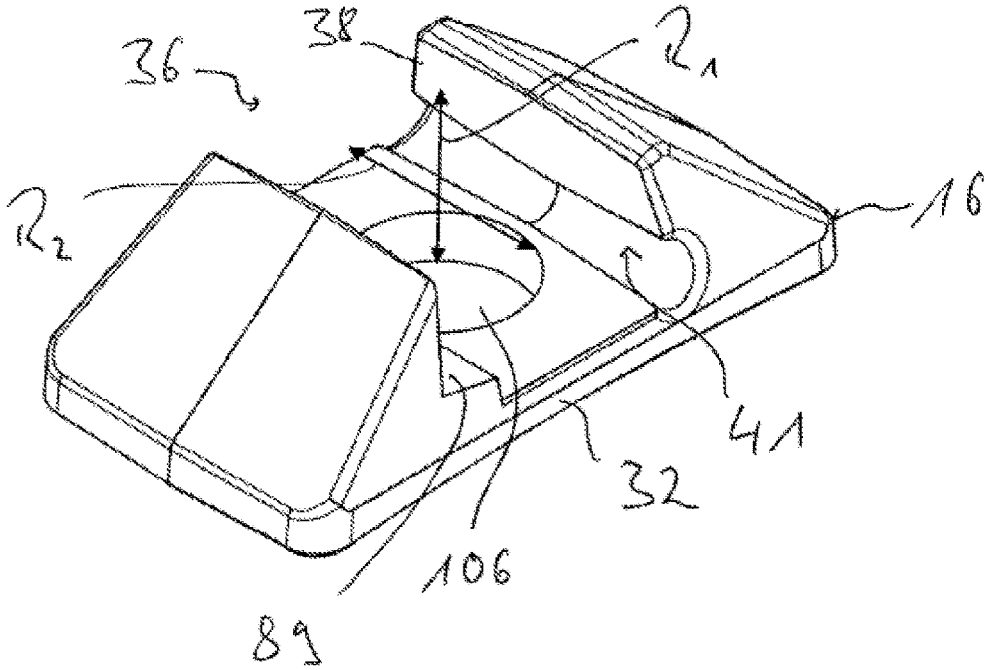
Figure 6:
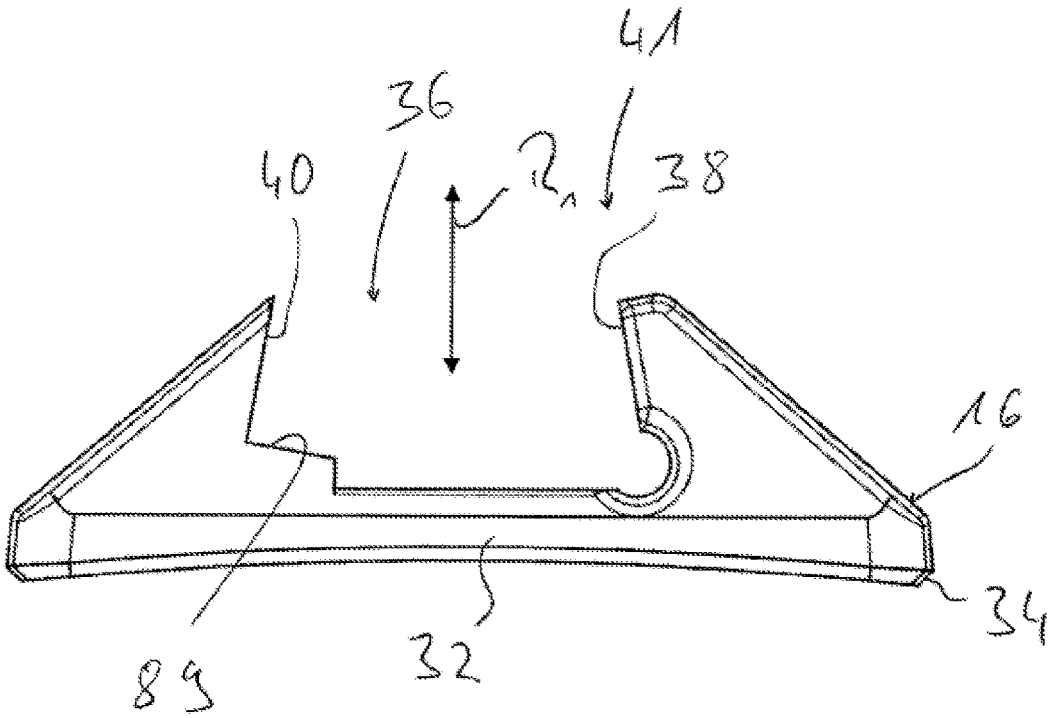
Figure 7:
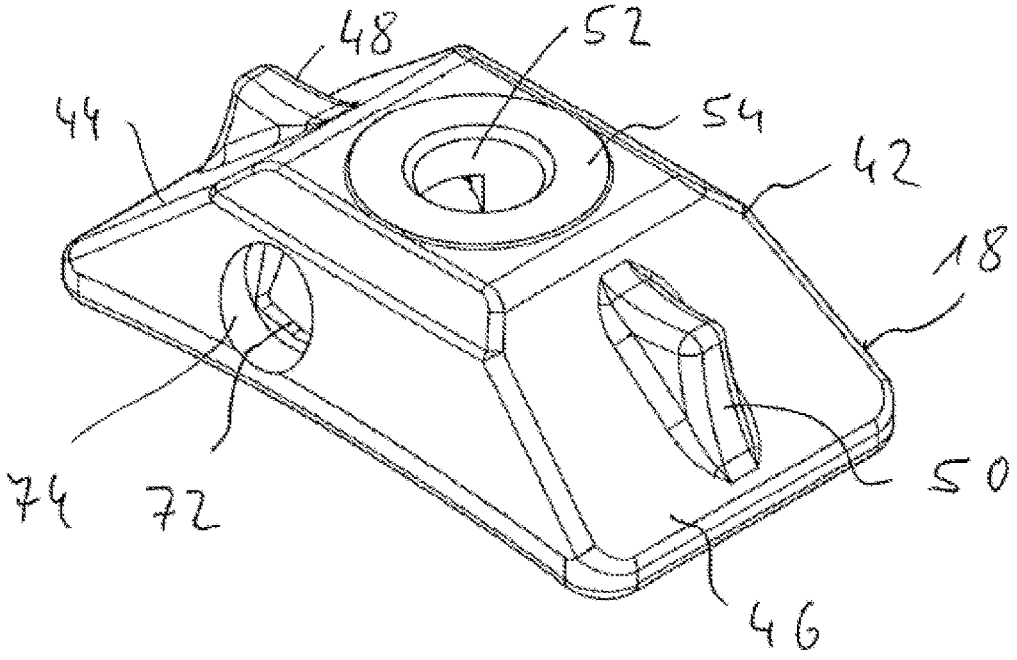
Figure 8:
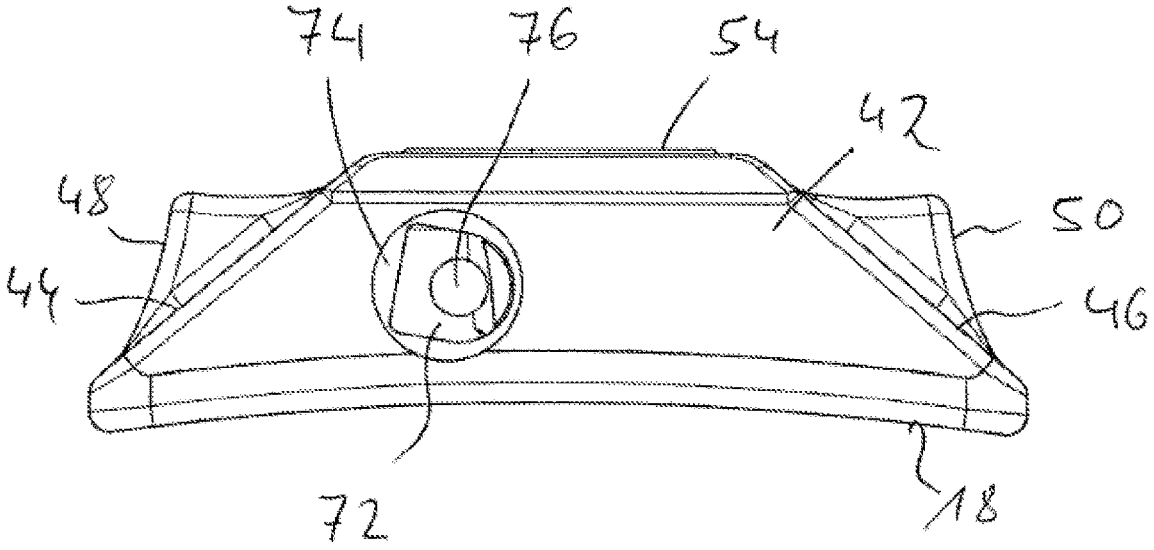
Figure 9:
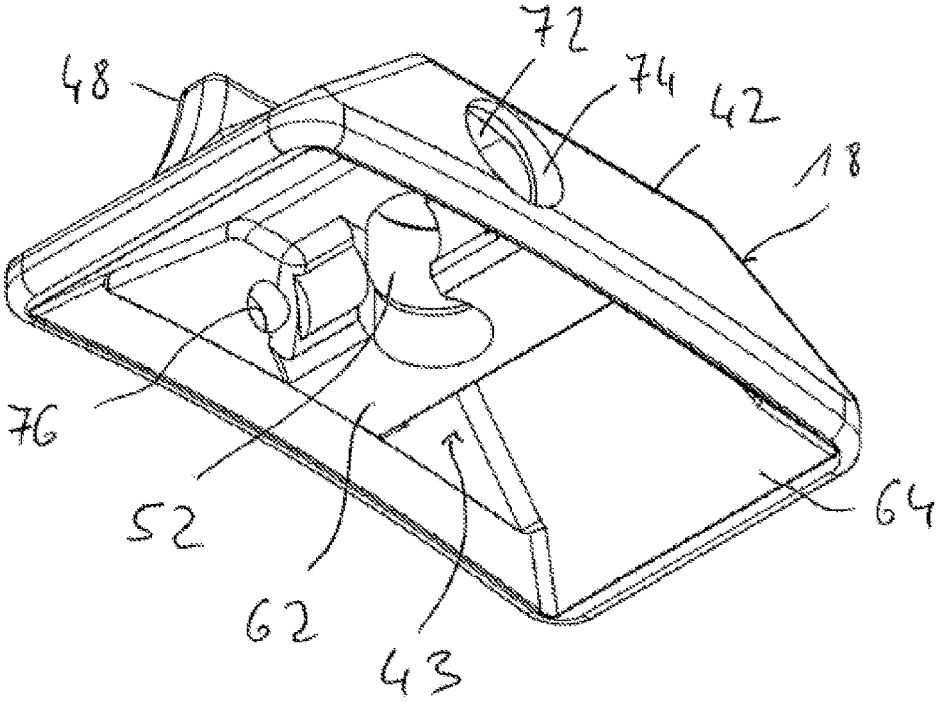
Figure 10:
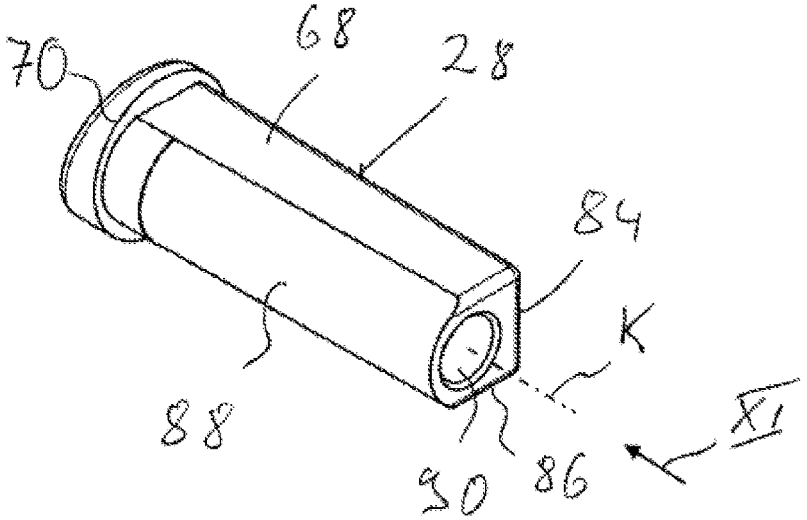
Figure 11:
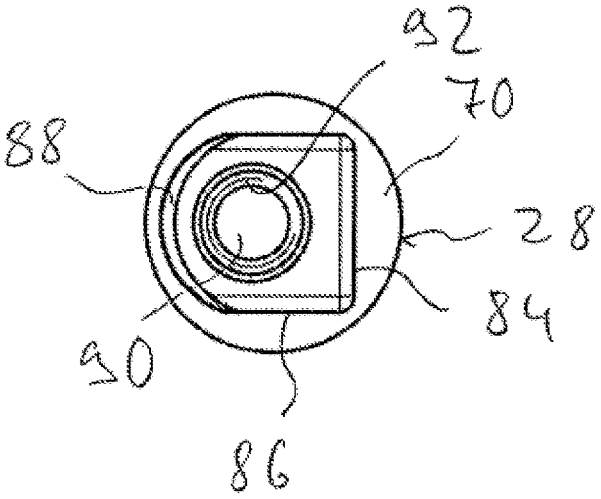
Figure 12:
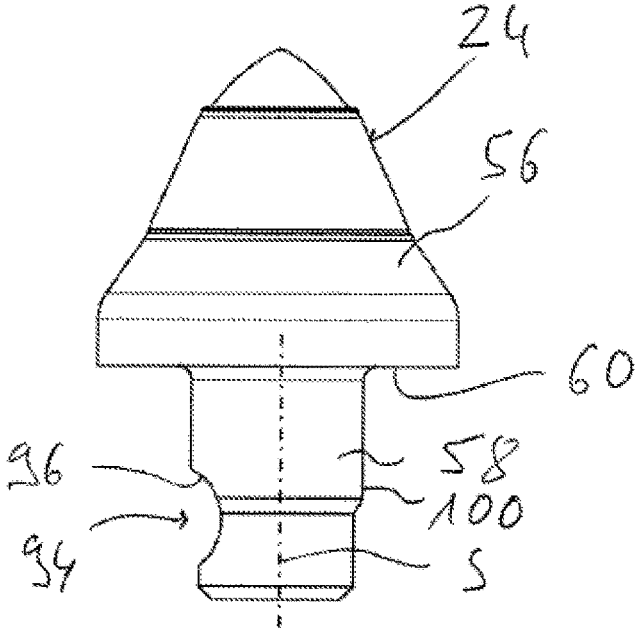
Figure 13:
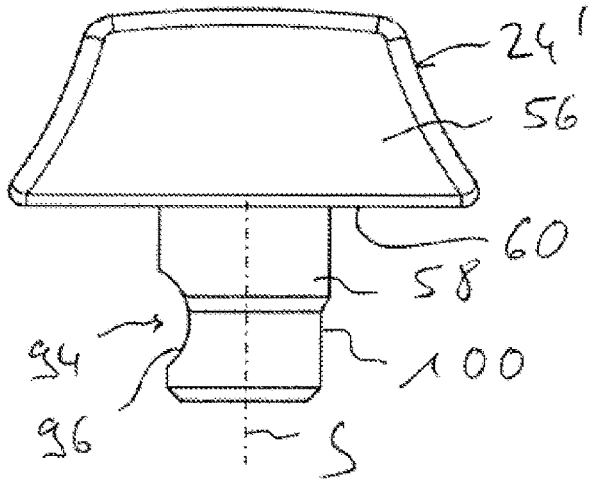
Figure 14:
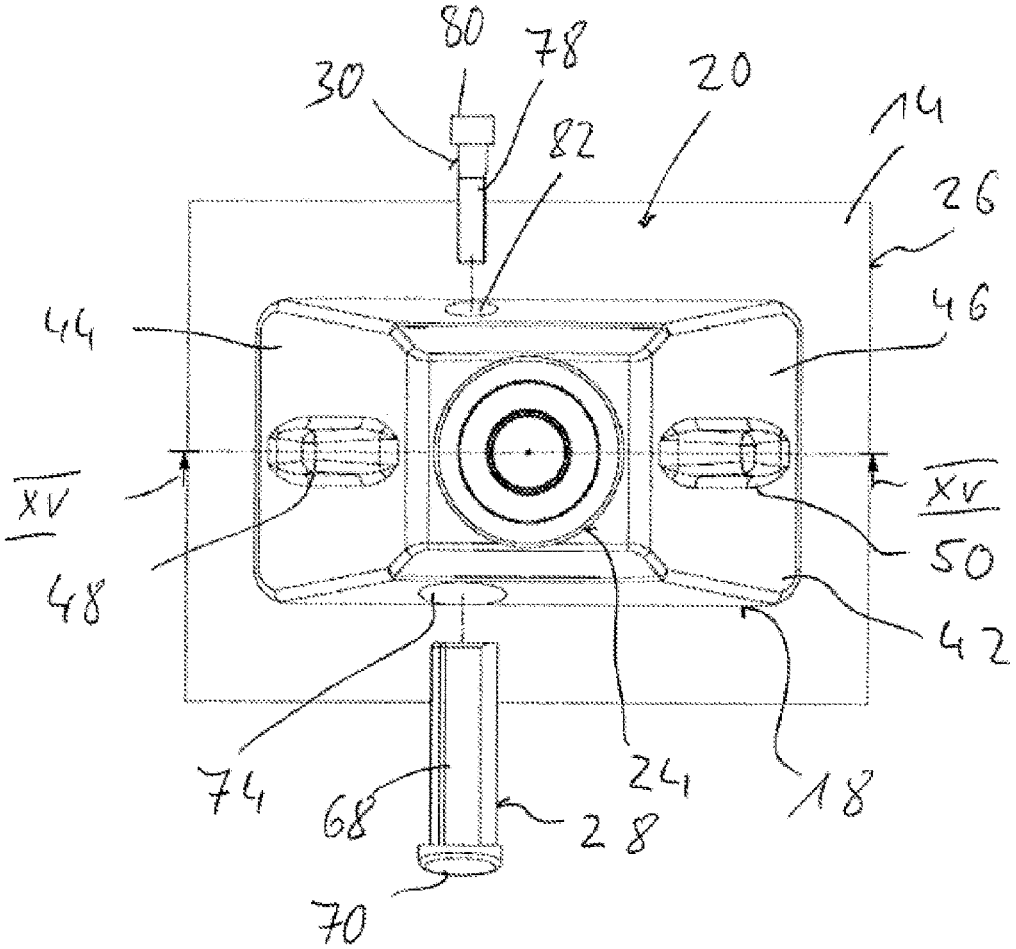
Figure 15:
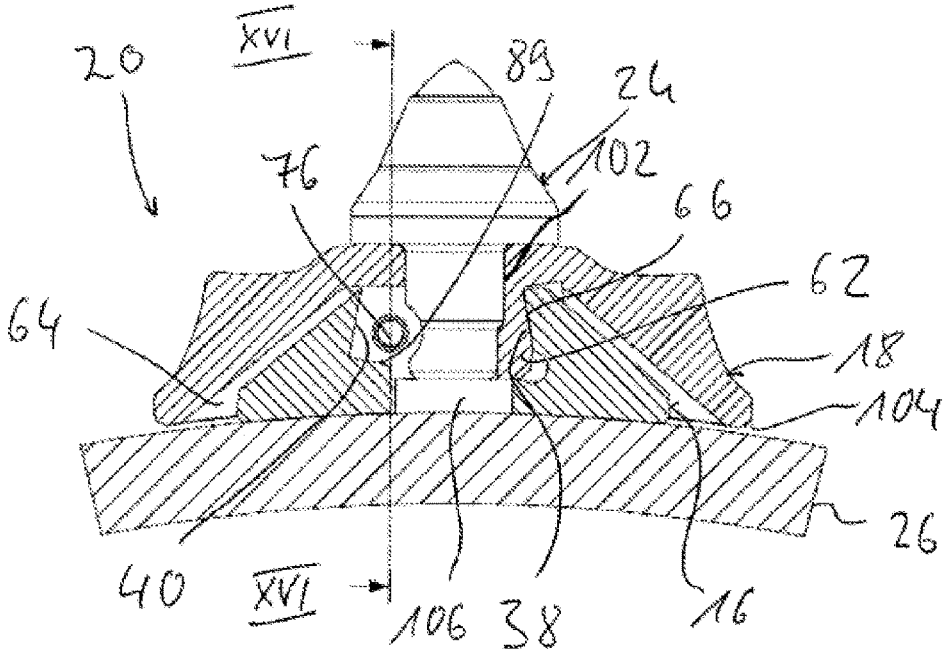
Figure 16:
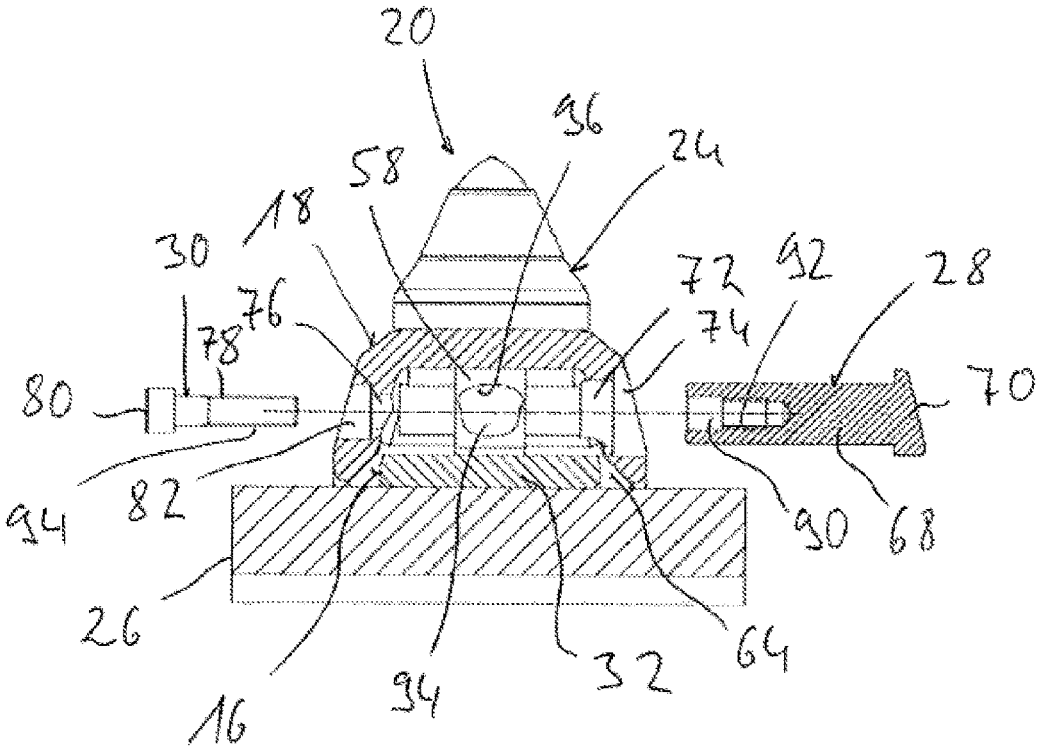
Figure 17:
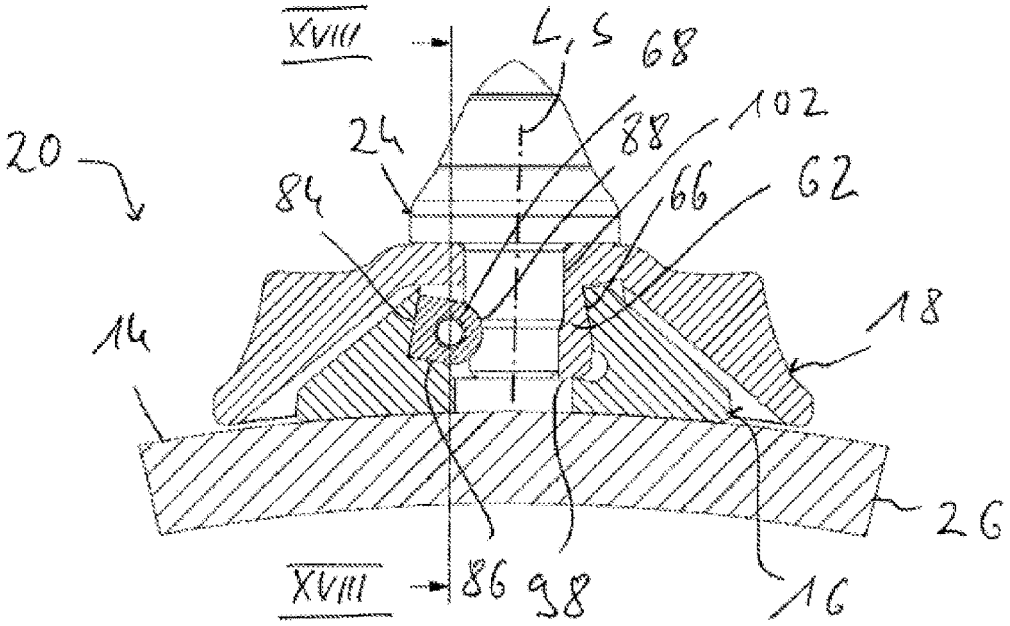
Figure 18:
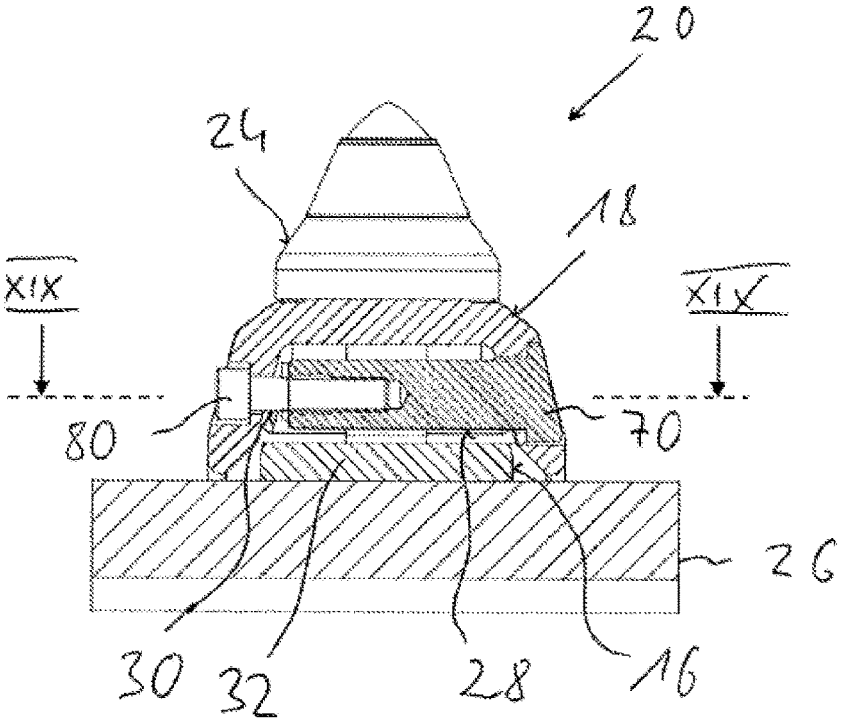
Figure 19:
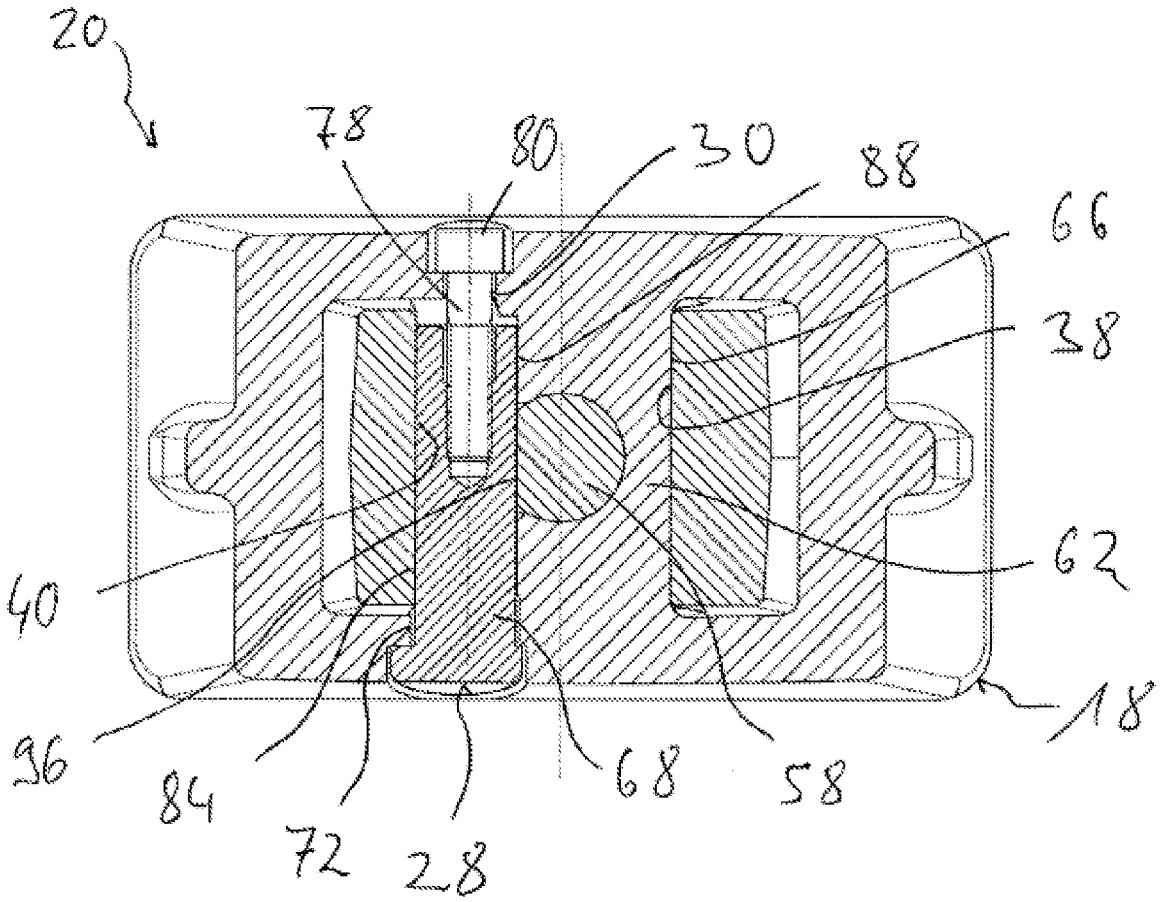

The present invention is described in detail below with reference to the accompanying figures. Shown are:

FIG. 1 a perspective view of a soil processing roller having a plurality of first tool carriers for interchangeable holders supported on an outer circumferential surface of a roller jacket;

FIG. 2 the soil processing roller of FIG. 1 with interchangeable tools in the form of chisels attached to interchangeable holders;

FIG. 3 the soil processing roller of FIG. 1 with interchangeable tools attached to interchangeable holders and designed as tamping feet;

FIG. 4 an exploded view of a roller tool;

FIG. 5 a tool carrier of the roller tool of FIG. 4 in perspective view;

FIG. 6 the side view of the tool carrier of FIG. 5;

FIG. 7 an interchangeable holder of the roller tool of FIG. 4 in perspective view;

FIG. 8 the side view of the interchangeable holder of FIG. 7;

FIG. 9 the bottom perspective view of the interchangeable holder of FIG. 7;

FIG. 10 a clamping member of the roller tool of FIG. 4 in perspective view;

FIG. 11 the clamping member of FIG. 10 in view direction XI in FIG. 10;

FIG. 12 the side view of an interchangeable tool in the form of a chisel for the roller tool of FIG. 4;

FIG. 13 the side view of an interchangeable tool of the roller tool of FIG. 4 in the form of a tamping foot;

FIG. 14 a top view of a roller tool in an assembly phase before the clamping member is attached;

FIG. 15 a sectional view of the roller tool in the phase of FIG. 14, cut along a line XV-XV in FIG. 14;

FIG. 16 a sectional view of the roller tool in the phase of FIG. 14, cut along a line XVI-XVI in FIG. 15;

FIG. 17 a sectional view corresponding to FIG. 15 with the roller tool assembled;

FIG. 18 a sectional view of the assembled roller tool of FIG. 17, cut along a line XVIII-XVIII;

FIG. 19 a sectional view of the assembled roller tool of FIG. 17, cut along a line XIX-XIX in FIG. 18.

In FIG. 1, a soil processing roller for a soil processing machine constructed, for example, in the manner of a soil compactor is generally designated with 10. The soil processing roller 10 includes a roller jacket 12 surrounding a roller rotation axis A and having an outer circumferential surface 14. A plurality of tool holders 16 for interchangeable holders, generally designated with 18, of roller tools generally designated with 20, are secured by bolting or welding to the outer circumferential surface 14 of the roller jacket 12. The tool carriers 16 are arranged in a plurality of rings following one another in the circumferential direction in the direction of the roller rotation axis A, wherein, for example, the tool carriers 16 arranged in rings directly following one another in the axial direction are arranged offset from one another in the circumferential direction.

FIG. 2 shows the soil processing roller 10 of FIG. 1 with the complete roller tools 20. In addition to the tool carriers 16, which are fixed to the roller jacket 12 by welding, these comprise interchangeable tools 24, which are held on interchangeable holders 18 and are in the form of chisels.

In the soil processing roller 10 shown in FIG. 3, the roller tools 20 comprise roller tools 24' in the form of tamping feet supported on the interchangeable holders 18.

Before the structure of the roller tools 20, i.e., the structure of the interchangeable holders 18 and the interchangeable tools 24 or 24', is discussed in more detail below, it should be pointed out that in the soil processing rollers 10 shown in FIGS. 1 to 3, the interchangeable holders 18 of the roller tools 20 are fixed directly to the roller jacket 12 providing a carrier jacket 26. In an alternative embodiment, the carrier jacket 26 could be a wrapping jacket constructed, for example, with a plurality of jacket segments, which can be arranged to surround the roller jacket 12 of such a soil processing roller 10 if required.

FIG. 4 shows an exploded view of a roller tool 20 shown in FIGS. 2 and 3 when attached to a soil processing roller 10 with the two different types of interchangeable tools 24, 24'. In addition to the interchangeable tools 24, 24', the other main system areas of tool carrier 16, interchangeable holder 18 and a clamping member 28 explained in more detail below and a fastening member 30 assigned to it can be seen.

The tool carrier 16, which is to be fixed to the outer circumferential surface 14 of the carrier jacket 26, for example of the roller jacket 12, by material locking, in particular welding, is shown in more detail in FIGS. 5 and 6. The tool carrier 16 includes a substantially plate-like tethering area 32, which is curved to conform to the circularly curved outer circumferential contour of the carrier jacket 26 and is surrounded by a chamfer 34. A weld seam, with which the tethering area 32 can be materially connected to the outer circumferential surface 14, can be produced, substantially completely surrounding the tethering area 32, engaging in the chamfer 34 and thus realizing a stable holding of the tool carrier 16.

A tool carrier clamping recess 36 is formed on the tool carrier 16 such that it is open in a direction $R_1$ away from the tethering area 32, which corresponds substantially to a direction radial with respect to the roller rotational axis A, and also in a direction $R_2$, which is substantially orthogonal to the direction $R_1$ and oriented substantially parallel to the roller rotational axis A. The tool carrier clamping recess is bounded by a first clamping surface 38 and a second clamping surface 40 opposite thereto. As FIG. 6 clearly shows, the opposing clamping surfaces 38, 40 are inclined with respect to each other in such a way that in the direction $R_1$ away from the tethering area 32 their mutual distance decreases, i.e., when attached to a soil processing roller 10 essentially a circumferential distance with respect to the roller rotation axis A.

The two clamping surfaces 38, 40 are preferably also positioned with respect to each other in such a way that their mutual distance in the direction $R_2$ is not constant, but here too the distance in this direction $R_2$ decreases. In particular, the design can be such that the distance of the two clamping surfaces 38, 40 with respect to each other decreases slightly in the direction $R_2$ in the illustration of FIG. 5 from the right front to the left rear. Furthermore, the two clamping surfaces 38, 40 are preferably formed as flat, substantially uncurved surfaces.

The interchangeable holder 18 shown in FIGS. 7 to 9 is formed with a hood- or cap-like interchangeable holder body 42. In the state of attachment of the interchangeable holder 18 to the tool carrier 16, which can be seen more clearly in FIGS. 15 and 17, the interchangeable holder body 42 completely covers the tool carrier 16 and also the weld seam connecting the latter to the carrier jacket 26, so that the tool carrier 16 is protected against external influences.

On two set end faces 44, 46 of the interchangeable holder body 42, oriented in the circumferential direction with respect to the axis of rotation A of the roller when attached to a soil processing roller 10, outwardly projecting breaking projections 48, 50 are provided which, in particular when an interchangeable tool 24 designed as a chisel is used, support the working process to be carried out by this interchangeable tool 24.

An interchangeable holder opening 52 is formed in the interchangeable holder 18 or in the interchangeable holder body 42. This is elongated in the direction of an opening longitudinal axis L which is oriented essentially orthogonally to the roller rotation axis A and thus extends radially with respect to the latter, and is surrounded by a ring-like support surface 54. An interchangeable tool body 56 of the interchangeable tool 24 or 24' can be supported on this with a counter-support surface 60 surrounding an interchangeable tool shank 58 of the same in a ring-like manner.

An interchangeable holder clamping projection 62, shown in FIG. 9, is formed on the interchangeable holder 18 or interchangeable holder body 42. This extends into a tool carrier receiving recess 64 surrounded by the interchangeable holder body.

A substantially uncurved first counter-clamping surface 66 is formed on the interchangeable holder clamping projection 62 in association with the first clamping surface 38 of the tool carrier 16, and is visible in FIGS. 15 and 17. Corresponding to the adjustment of the first clamping surface 38, the first counter-clamping surface 66 is also adjusted and thus angled with respect to the longitudinal opening axis L in such a way that the distance of the first counter-clamping surface 66 increases in the direction of the longitudinal opening axis L away from the support surface 54. When the clamping interaction between the tool carrier 16 and the interchangeable holder 18 is established in the manner described below, the first clamping surface 38 and the first counter-clamping surface 66 are in surface-to-surface contact with each other.

In the design of a roller tool 20 according to the invention, the tool carrier clamping recess 36 and the two clamping surfaces 38, 40 bounding the tool carrier clamping recess 36 substantially provide an interchangeable holder clamping region 41 of the tool carrier 16, while the interchangeable tool clamping projection 62 substantially provides with its first counter-clamping surface 66 an interchangeable holder counter-clamping region 43 of the interchangeable holder 18.

The clamping member 28 shown in FIGS. 10 and 11 is formed with a clamping member shank 68 elongated in the direction of a longitudinal clamping member axis K and a clamping member head 70. In association with the clamping member 28, a clamping member through-engagement opening 72 is formed in the interchangeable holder body 42 with a clamping member head receiving area 74 in which, as can be seen in FIG. 18, the clamping member head 70 can be substantially completely received and supported with respect to the interchangeable holder body 42.

Opposite the clamping member through-engagement opening 72, a fastening member through-engagement opening 76 is formed in the interchangeable holder body 42 through which the fastening member 30 can pass with a fastening member shank 78 for fastening interaction with the clamping member 28. To receive a fastener head 80, the fastening through-engagement opening 76 includes an expanded fastening member head receiving area 82.

The clamping member 28 has a second counter-clamping surface 84 on its clamping member shank 68 in association with the second clamping surface 40 of the tool carrier 16. The second counter-clamping surface 84, like the second clamping surface 40, is substantially flat, i.e., uncurved, so that in the assembled state shown in FIG. 17, the clamping member 28 is in flat abutting contact with its second counter-clamping surface 84 against the second clamping surface 40. To assist in a defined positioning of the clamping member 28, for example, the clamping member 28 may have a retaining surface 86 orthogonal to the second counter-clamping surface 84, which can be supported on a counter-retaining surface 89 formed on the tool carrier 16 and arranged substantially orthogonal to the second clamping surface 40 substantially in a radially inward direction.

A third counter-clamping surface 88 is formed on the clamping member shank 68 in a circumferential region opposite the second counter-clamping surface 84 with respect to the longitudinal axis K of the clamping element. The third counter-clamping surface 88 has a convexly curved contour about the longitudinal axis K of the clamping member.

In particular, the clamping member 28 is formed in the region of its clamping member shank 68 with a generally wedge-like structure such that the clamping member shank 68 has a tapering contour in the direction of the longitudinal axis K of the clamping member away from the clamping member head 70. This means that the second counter-clamping surface 84 has a decreasing distance from the longitudinal clamping member axis K in the direction away from the clamping member head 70. The same applies to the third counter-clamping surface 88. Because of its convex structure, this is formed, for example, with the contour of a circumferential portion of a truncated cone, so that the radius of curvature of the third counter-clamping surface 88 decreases with respect to the longitudinal clamping member axis K with, for example, a substantially circular curvature in the direction away from the fastening member head 70.

FIGS. 10 and 11 further show that an opening 90 is formed in the clamping member shank 68, which is open in the direction of the longitudinal clamping member axis K in the direction away from the clamping member head 70. An internal thread providing a fastening threaded area 92 is formed in the opening 90. An external thread providing a counter-fastening threaded area 94 is provided on the fastening member shank 78 of the fastening member 30, so that the fastening member 30 can be screwed with its fastening member shank 78 or the external thread provided thereon into the internal thread in the opening 90 of the clamping member shank 68 in the manner shown in FIG. 18 in order to secure the clamping member 28.

An interchangeable tool clamping recess 94 open substantially transversely to a shank longitudinal axis S is formed on the interchangeable tool shank 58 of the interchangeable tool 24 or 24' visible in side view in FIGS. 12 and 13, which may be of stepped cylindrical configuration to aid easy insertion into the interchangeable holder opening 52. This has a complementary concave shape to the third counter-clamping surface 88 and provides a correspondingly curved third clamping surface 96. The third clamping surface 96 can also be designed to taper in a frustoconical manner in a direction substantially orthogonal or skew to the longitudinal shank axis S in correspondence with the frustoconical or tapered contour of the third counter-clamping surface 88, so that in the assembled state a planar abutting contact is achieved between the third counter-clamping surface 88 and the third clamping surface 96.

In order to assemble a roller tool 20 described above with respect to its various components, it is possible to proceed in such a way that first an interchangeable holder 18 is brought up to the carrier jacket 26 from radially outside, covering an associated tool carrier 16. At this time, the interchangeable holder clamping projection 62 enters the tool carrier clamping recess 36. The interchangeable holder 18 can, for example, be positioned in such a way that its first counter-clamping surface 66 is already in contact with the first clamping surface 38 or is opposite it by a small distance. Furthermore, in this state, the interchangeable holder 18 can abut the tethering area 32 of the tool carrier 16 with an end face 98 formed on the interchangeable holder clamping projection 62 and oriented substantially orthogonally to the longitudinal axis L of the opening.

Before or after the positioning of the interchangeable holder 18 with respect to a tool carrier 16 described above, the interchangeable tool 24, for example, can already be inserted into the interchangeable holder opening 52 so that its interchangeable tool shank 58 is positioned to engage in the interchangeable holder opening 52. The interchangeable tool 24 or 24' is thereby positioned in the circumferential direction with respect to the longitudinal opening axis L in such a way that the interchangeable tool clamping recess 94 is oriented away from the first counter-clamping surface 66 provided on the interchangeable tool clamping projection 62. Alternatively, this orientation of the interchangeable tool clamping recess 94 can also be provided by rotating the interchangeable tool 24 or 24' when the interchangeable holder 18 is already positioned on the tool carrier 16.

Subsequently, the clamping member 28 with its clamping member shank 68 is passed through the clamping member through-engagement opening 72 in the interchangeable holder body 42 with such an orientation that the second counter-clamping surface 84 is opposite the second clamping surface 40 and the retaining surface 86 is opposite the counter-retaining surface 89 or is in contact therewith, respectively. As a result, the clamping member 28 is automatically oriented such that the third counter-clamping surface 88 formed thereon faces the third clamping surface 96 on the interchangeable tool shank 58.

As the clamping member 28 moves in the direction of the longitudinal clamping member axis K through the clamping member through-engagement opening 72, increasing contact pressure is generated between the second clamping surface 40 and the second counter-clamping surface 84 on the one hand and the third clamping surface 96 and the third counter-clamping surface 88 on the other hand. As a result, a force acting on the interchangeable tool shank 58 substantially orthogonally to the shank longitudinal axis S is exerted, which presses the interchangeable tool shank 58 with a circumferential surface area 100 opposite the interchangeable tool clamping recess 94 in the circumferential direction with respect to the shank longitudinal axis S against a circumferential surface area 102 of the interchangeable holder 18 opposite the latter and surrounding the interchangeable holder opening 52. As a result, the interchangeable holder shank 58 presses the interchangeable holder clamping projection 62 with its first counter-clamping surface 66 against the first clamping surface 38 on the tool carrier 16.

The clamping member 28, which is supported directly with respect to the tool carrier 16 and indirectly with respect to the interchangeable holder 18 via the interchangeable tool 24, 24' or the interchangeable tool shank 58, thus generates a clamping interaction which results in both a stable holding of the interchangeable holder 18 on the tool carrier 16 and a stable holding of the interchangeable tool 24, 24' on the interchangeable holder 18. Since the clamping surfaces 38, 40 provided on the tool carrier 16 are inclined towards each other in the radially outward direction, a force effect is simultaneously generated which acts radially inwardly on the tool holder 18 with respect to the tool carrier 16, so that the interchangeable holder 18 is supported in a radially inwardly defined manner in the region of its end face 98 on the tool carrier 16 or its tethering area 32, but does not touch the outer circumferential surface 14 of the carrier jacket 26 with its interchangeable holder body 42 which surrounds or shields the tool carrier 16, thus forming a gap-like intermediate space 104 with respect to the latter.

By the adjustment of the second clamping surface 40 and the resulting adjustment of the second counter-clamping surface 84 with respect to the longitudinal opening axis L or longitudinal axis S, the clamping member 28 not only presses the interchangeable tool shank 58 against the interchangeable holder 18 substantially orthogonally to the shank longitudinal axis S thereof, but a force component is also generated which directs the interchangeable tool shank 58 in the direction of the shank longitudinal axis S towards the tethering area 32 of the tool carrier 16, and this in turn causes the interchangeable tool 24 or 24' with the counter-support surface 60 formed on the interchangeable tool body 56 to be pressed against the support surface 54 formed on the interchangeable holder 18. To enable this, a recess or opening 106 receiving the axial end portion of the interchangeable tool shank 58 may be formed in the attachment portion 32 of the tool carrier 16.

The bracing of the various system areas of the roller tool 20 with respect to one another caused by the wedging action of the clamping member 28 can be produced in a particularly simple manner by the fact that, after the clamping member 28 has been fully inserted into the interchangeable holder 18 in the manner described above, the fastening member 30 is screwed with its external thread into the internal thread of the clamping member 28 and thus exerts increased pressure on the clamping member 28 in the direction of the longitudinal axis K of the clamping member until a maximum clamping action is achieved. In this state, for example, the clamping member head 70 may be supported on the interchangeable holder 18 in the direction of the longitudinal axis K of the clamping member or may still be at a slight distance from it. The fastening member head 80 is supported in the fastening member head receiving area 82 on the interchangeable holder 18.

While the defined contact interaction between the first clamping surface 38 and the first counter-clamping surface 66 fixes the positioning of the interchangeable holder 18 with respect to the tool carrier 16 in the circumferential direction with respect to the roller rotational axis A, the interchangeable holder 18 can be displaced slightly with respect to the tool carrier 16 in the direction of the roller rotational axis A before the clamping interaction is generated, because or if the interchangeable holder counter-clamping region 43 or the interchangeable holder clamping projection 62 has a slightly larger extension in the direction of the roller rotation axis A than the tool carrier 16 in the area of its interchangeable holder clamping region 41 or its two clamping surfaces 38, 40. This allows fine adjustment of the interchangeable holders 18 in the direction of the roller rotation axis.

In the roller tool designed according to the invention, simple structural measures are taken to enable the mounting and also the dismounting of an interchangeable holder on or from an associated tool carrier. In particular, the interchangeable holder and the tool carrier can be designed as forged components, wherein the surfaces to be brought into contact with one another can be provided with high precision, for example by machining. The interchangeable holder can be designed with a substantially constant wall thickness in the area of its interchangeable holder body and thus provide reliable protection for the associated tool carrier, which is to be attached to a carrier jacket in a material-locking manner.

The invention claimed is:

1. A roller tool for a soil processing roller of a soil processing machine, comprising:

a tool carrier to be fixed to an outer circumferential side of a carrier jacket, having a tethering area for fixedly tethering the tool carrier to an outer circumferential surface of the carrier jacket and an interchangeable holder clamping region, an interchangeable tool having an interchangeable tool shank elongated in the direction of a shank longitudinal axis, an interchangeable holder with an interchangeable holder opening elongated in the direction of a longitudinal opening axis for receiving the interchangeable tool shank of the interchangeable tool to be detachably fixed to the interchangeable holder and with an interchangeable holder counter-clamping region, wherein the interchangeable holder counter-clamping region is to be brought into clamping interaction with the interchangeable holder clamping region for detachably fixing the interchangeable holder to the tool carrier, and a clamping member to be supported for generating the clamping interaction with respect to the tool carrier and the interchangeable holder, wherein the interchangeable holder comprises an interchangeable holder body having a tool carrier receiving recess substantially completely receiving the tool carrier.

2. The roller tool according to claim 1, wherein the clamping member has a clamping member shank elongated in the direction of a clamping member longitudinal axis, and in that the clamping member shank is designed to taper at least in regions in the direction of the clamping member longitudinal axis.

3. The roller tool according to claim 1, wherein the interchangeable holder clamping region on the tool carrier comprises a tool carrier clamping recess, wherein the tool carrier clamping recess is bounded by a first clamping surface and a second clamping surface opposite the first clamping surface, and in that the interchangeable holder counter-clamping region on the interchangeable holder comprises an interchangeable holder clamping projection to be positioned in an engaging manner in the tool carrier clamping recess, wherein a first counter-clamping surface to be brought into contact with the first clamping surface by the clamping member for producing the clamping interaction is provided on the interchangeable holder clamping projection, and wherein a second counter-clamping surface to be brought into contact with the second clamping surface for producing the clamping interaction is provided on the clamping member.

4. The roller tool according to claim 3, wherein the interchangeable holder clamping projection is formed extending from the interchangeable holder body into the tool carrier receiving recess.

5. The roller tool according to claim 3, wherein the first clamping surface and the second clamping surface are inclined toward each other in a direction away from the tethering area, or/and the first clamping surface and the second clamping surface are inclined toward each other in a direction orthogonal to the direction away from the tethering area, or/and the first clamping surface, the second clamping surface, the first counter-clamping surface, and the second counter-clamping surface are substantially uncurved.

6. The roller tool according to claim 3, wherein a third clamping surface is provided on the interchangeable tool shank, and in that a third counter-clamping surface to be brought into contact with the third clamping surface for producing the clamping interaction is provided on the clamping member.

7. The roller tool according to claim 6, wherein an interchangeable tool clamping recess is provided on the interchangeable tool shank, which is open substantially transversely to the shank longitudinal axis and provides the third clamping surface.

8. The roller tool according to claim 6, wherein the third clamping surface is concavely curved, and in that the third counter-clamping surface is complementarily convexly curved to the third clamping surface.

9. The roller tool according to claim 8, wherein the third counter-clamping surface has substantially the shape of a circumferential portion of a truncated cone.

10. The roller tool according to claim 1, wherein a clamping member through-engagement opening and a fastening member through-engagement opening opposite the clamping member through-engagement opening are provided in the interchangeable holder, wherein, in order to produce the clamping interaction, the clamping member is to be positioned so as to pass through the clamping member through-engagement opening and a fastening member holding the clamping member in the clamping member through-engagement opening is to be positioned so as to pass through the fastening member through-engagement opening.

11. The roller tool according to claim 10, wherein a fastening threaded area is provided on the clamping member, and in that a counter-fastening threaded area to be threadedly engaged with the fastening threaded area for retaining the clamping member in the clamping member through-engagement opening is provided on the fastening member.

12. The roller tool according to claim 11, wherein the fastening threaded area comprises an internal thread formed in an opening of the clamping member, and in that the counter-fastening threaded area comprises an external thread formed on a fastening member shank of the fastening member.

13. A soil processing roller comprising a plurality of roller tools according to claim 1, wherein the tool carriers of the roller tools are fixedly attached to a carrier jacket) by bolting or welding.

14. A soil processing roller according to claim 13, wherein the carrier jacket is a roller jacket of the soil processing roller, or in that the carrier jacket is a covering jacket to be arranged surrounding the roller jacket of the soil processing roller.

15. A soil processing machine comprising at least one soil processing roller according to claim 13.

16. A roller tool for a soil processing roller of a soil processing machine, comprising:

a tool carrier to be fixed to an outer circumferential side of a carrier jacket, having a tethering area for fixedly tethering the tool carrier to an outer circumferential surface of the carrier jacket and an interchangeable holder clamping region, an interchangeable tool having an interchangeable tool shank elongated in the direction of a shank longitudinal axis, an interchangeable holder with an interchangeable holder opening elongated in the direction of a longitudinal opening axis for receiving the interchangeable tool shank of the interchangeable tool to be detachably fixed to the interchangeable holder and with an interchangeable holder counter-clamping region, wherein the interchangeable holder counter-clamping region is to be brought into clamping interaction with the interchangeable holder clamping region for detachably fixing the interchangeable holder to the tool carrier, and a clamping member to be supported for generating the clamping interaction with respect to the tool carrier and the interchangeable holder, wherein the interchangeable holder clamping region on the tool carrier comprises a tool carrier clamping recess, wherein the tool carrier clamping recess is bounded by a first clamping surface and a second clamping surface opposite the first clamping surface, and in that the interchangeable holder counter-clamping region on the interchangeable holder comprises an interchangeable holder clamping projection to be positioned in an engaging manner in the tool carrier clamping recess, wherein a first counter-clamping surface to be brought into contact with the first clamping surface by the clamping member for producing the clamping interaction is provided on the interchangeable holder clamping projection, and wherein a second counter-clamping surface to be brought into contact with the second clamping surface for producing the clamping interaction is provided on the clamping member.

17. The roller tool according to claim 16, wherein the first clamping surface and the second clamping surface are inclined toward each other in a direction away from the tethering area, or/and the first clamping surface and the second clamping surface are inclined toward each other in a direction orthogonal to the direction away from the tethering area, or/and the first clamping surface, the second clamping surface, the first counter-clamping surface, and the second counter-clamping surface are substantially uncurved.

18. The roller tool according to claim 16, wherein a third clamping surface is provided on the interchangeable tool shank, and in that a third counter-clamping surface to be brought into contact with the third clamping surface for producing the clamping interaction is provided on the clamping member.

19. The roller tool according to claim 18, wherein an interchangeable tool clamping recess is provided on the interchangeable tool shank, which is open substantially transversely to the shank longitudinal axis and provides the third clamping surface.

20. The roller tool according to claim 18, wherein the third clamping surface is concavely curved, and in that the third counter-clamping surface is complementarily convexly curved to the third clamping surface.

* * * * *